US012187469B1

(12) United States Patent
Liu et al.

(10) Patent No.: US 12,187,469 B1
(45) Date of Patent: Jan. 7, 2025

(54) METHOD FOR PACKING AN ARTICLE

(71) Applicants: TEKPAK CORPORATION, Taichung (TW); TRANSPAK EQUIPMENT CORPORATION, Taipei (TW)

(72) Inventors: Chin-Chang Liu, Taichung (TW); Chi-Jan Su, Taipei (TW)

(73) Assignee: TRANSPAK EQUIPMENT CORPORATION, Taichung (TW)

( * ) Notice: Subject to any disclaimer, the term of this patent is extended or adjusted under 35 U.S.C. 154(b) by 0 days.

(21) Appl. No.: 18/234,875

(22) Filed: Aug. 16, 2023

(51) Int. Cl.

| | |
|---|---|
| ***B65B 13/06*** | (2006.01) |
| ***B65B 13/16*** | (2006.01) |
| ***B65B 13/18*** | (2006.01) |
| ***B65B 13/22*** | (2006.01) |
| ***B65B 13/24*** | (2006.01) |

(52) U.S. Cl.
CPC ..... *B65B 13/06* (2013.01); *B65B 13/16* (2013.01); *B65B 13/181* (2013.01); *B65B 13/22* (2013.01); *B65B 13/24* (2013.01)

(58) Field of Classification Search
None
See application file for complete search history.

(56) References Cited

U.S. PATENT DOCUMENTS 3,329,262 A * 7/1967 Martin ..... B65D 71/0088 206/322
3,691,939 A * 9/1972 Goodley ..... B65B 13/06 100/29
3,949,662 A * 4/1976 Woomer ..... B65B 13/06 100/32
4,011,632 A 3/1977 MacDonald
4,587,791 A * 5/1986 Brouse ..... B65B 13/181 53/589
5,289,668 A * 3/1994 Meyer ..... B65B 13/181 53/410
6,360,932 B1 * 3/2002 Liu ..... B65B 13/186 226/90
6,745,678 B1 * 6/2004 Liu ..... B65B 13/06 53/589

FOREIGN PATENT DOCUMENTS

BE 890814 A * 2/1982 ..... B65B 11/045
DE 202010000360 U1 * 8/2010 ..... B65B 13/06
TW 200505746 A * 2/2005

* cited by examiner

*Primary Examiner* — Tanzim Imam
(74) *Attorney, Agent, or Firm* — Cheng-Ju Chiang

(57) ABSTRACT

A method for packing includes a preparing step, a moving step, a first time feeding strap step, an encircling article step, a first time tightening step, a second time feeding strap step, a manual inserting step, a second time tightening step, and a strap cutting and bonding step. A strap feeding and retreating control unit of the strapping machine is controlled to tighten the packing strap tightly around the article, and then the strap feeding and retreating control unit is controlled to automatically pull out the packing strap, so that two insertion spaces are created between the packing strap and the article. The two right-angle pad elements can be respectively inserted into the two insertion spaces. Then, the packing strap is tightened to tightly wrap around the article and the two right-angle pad elements. Next, the packing strap is cut and bonded to complete the packing action of the article.

2 Claims, 9 Drawing Sheets

METHOD FOR PACKING AN ARTICLE

BACKGROUND OF THE PRESENT INVENTION

Field of Invention

The present invention relates to a method for packing an article, in particular to the method for packing an article on a pallet that can be operated by a single person and without the falling of two right-angle pad elements after being placed.

Description of Related Arts

As shown in FIGS. 14 and 15, it is a conventional method for packing an article, such as packing an article 82 (for example, stacked cartons or goods) on a pallet 81, and the process of the method can be briefly described as follows:

Step 1: at first, moving a strapping machine 83 and partially inserting an L-shaped strap guiding portion 831 thereof and then extending below the pallet 81; that is, the L-shaped strap guiding portion 831 can output a packing strap 832 from the bottom of the pallet 81.

Step 2: placing two right-angle pad elements 84 on the article 82.

Step 3: pulling the packing strap 832 out and wrapping around the article 82 and the two right-angle pad elements 84, and inserting one end of the packing strap 832 back into the L-shaped strap guiding portion 831.

Step 4: utilizing the existing functions of the strapping machine 83 (known technology, not described in detail) to tighten, cut and bond the packing strap 832.

Step 5: finally, completing the conventional bundling of placing two right-angle pad elements 84 on the article 82.

However, in the process of steps 2 to 4, when the two right-angle pad elements are placed on the article, the two right-angle pad elements cannot be restrained by the packing strap. Therefore, the two right-angle pad elements must be pressed and secured by two hands of one person (or operator) so as to prevent loosening or falling down, which is very troublesome.

Hence, the above-mentioned conventional method requires an operator (one person) to control the strapping machine and requires another operator (another person) to press and secure on the two right-angle pad elements with both hands at the same time. Under this condition, two operators (or two persons) are required. It means the manpower requirement for such packing work is relatively high.

Therefore, it is necessary to develop a new technology that can solve the above-mentioned conventional shortcomings.

SUMMARY OF THE PRESENT INVENTION

The purpose of the present invention is to provide a method for packing an article, which has the advantages of two right-angle pad elements that will not fall after placement and can be operated by a single person. In particular, the problem to be solved by the present invention is that in the conventional method, one person is required to control the strapping machine, and another person's hands are required to press and secure on the two right-angle pad elements, which means two persons are required; and the manpower requirement for such packing work is relatively high.

The technical means to solve the above problems is to provide a method for packing an article, which includes the following steps:

S1. preparing step;
S2. moving step;
S3. first time feeding strap step;
S4. encircling article step;
S5. first time tightening step;
S6. second time feeding strap step;
S7. manual inserting step;
S8. second time tightening step; and
S9. strap cutting and bonding step.

DETAILED DESCRIPTION OF THE PREFERRED EMBODIMENT

Figure 1:
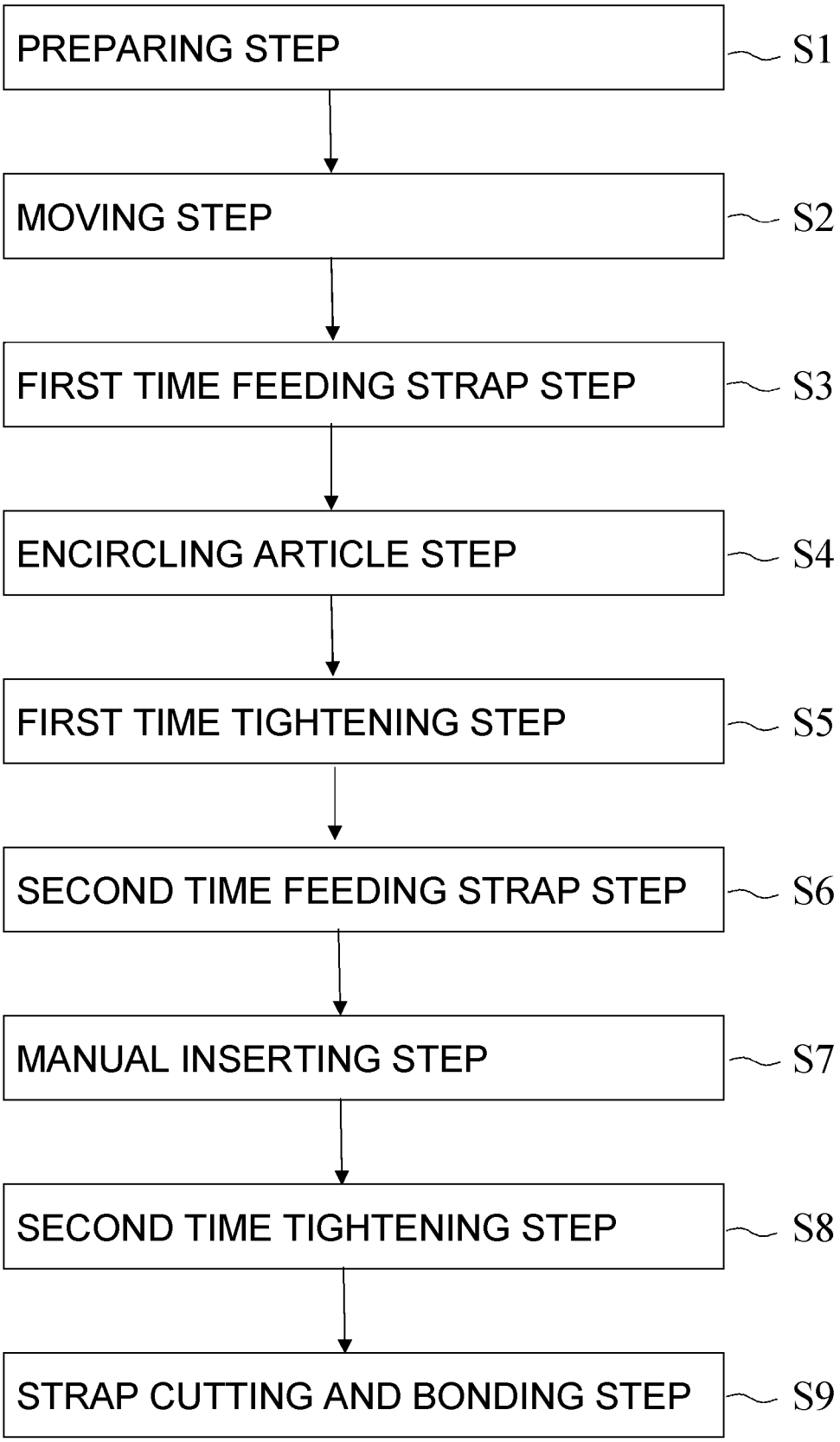
FIG. 1 is a flow diagram of the method for packing an article of the present invention.

Referring to FIGS. 1, 2, 3, 4, 5, 6, 7, 8, 9, 10, and 11, the present invention is a method for packing an article, which comprises the following steps:

1. preparing step S1: preparing an article 10, a pallet 20, a strapping machine 30, and at least two right-angle pad elements 40. The article 10 has a top surface 11, a bottom surface 12, and four side surfaces 13 respectively arranged thereon (referring to FIGS. 12 and 13). The top surface 11 has a first edge 111 and a second edge 112 respectively arranged thereon. The bottom surface 12 of the article 10 is placed on the pallet 20. The pallet 20 has a bottom space 21 disposed thereon. The strapping machine 30 has a plurality of movable wheels 31, a strap supply unit 32, a strap feeding and retreating control unit 33, a strap cutting and bonding unit 34, and an L-shaped strap guide unit 35 respectively arranged thereon. The plurality of movable wheels 31 are used to carry the strapping machine 30 to move. The strap supply unit 32 is used to provide a packing strap 91. The packing strap 91 has a supply end 911, wherein the supply end 911 is capable of being pulled out from the strap supply unit 32, passing through the strap feeding and retreating control unit 33, the strap cutting and bonding unit 34 in sequence, and finally being set on the L-shaped strap guide unit 35. The L-shaped strap guide unit 35 has a strap outlet portion 351, a strap return portion 352 and a stopper portion 353 respectively arranged thereon. In which, the supply end 911 is disposed on the strap outlet portion 351.

Figure 2:
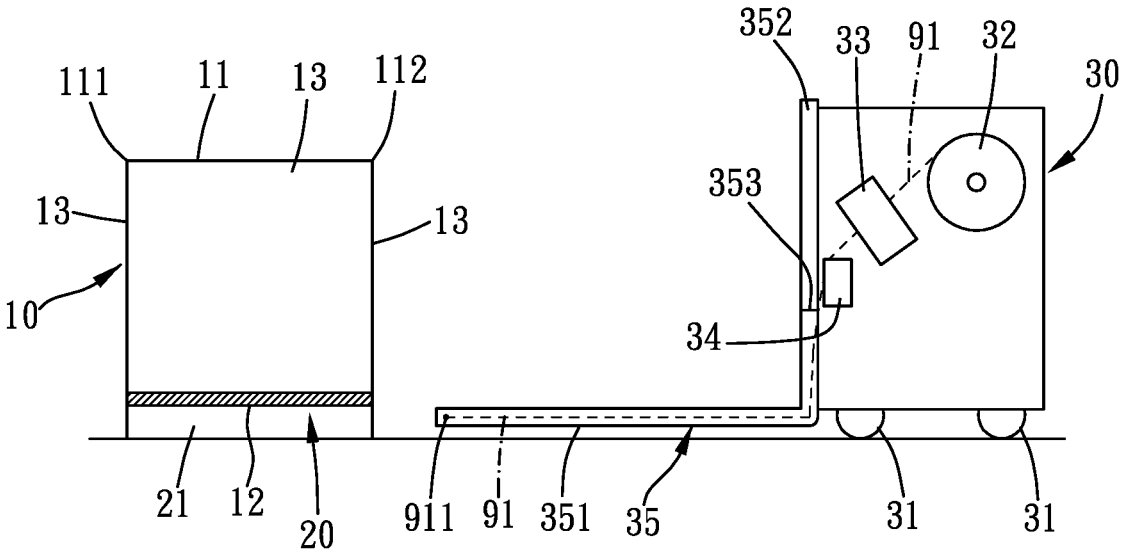
FIG. 2 is a perspective view of process 1 of the method for packing an article of the present invention.
Figure 3:
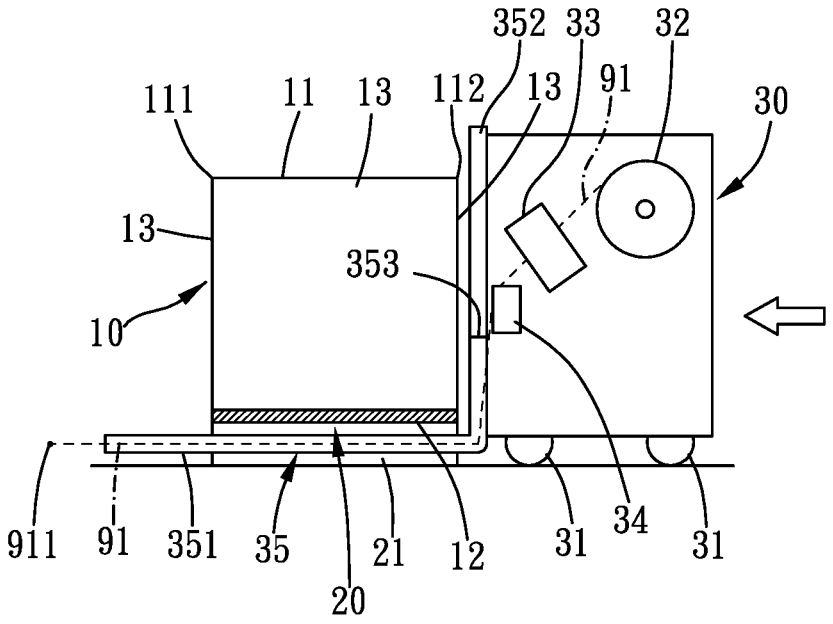
FIG. 3 is a perspective view of process 2 of the method for packing an article of the present invention.

2. moving step S2: moving the strapping machine 30 by the plurality of movable wheels 31, and then making the strap outlet portion 351 of the L-shaped strap guide unit 35 extend into the bottom space 21 (as shown in FIG. 2 to FIG. 3).

3. first time feeding strap step S3: controlling the strap feeding and retreating control unit 33 to feed the packing strap 91 so that the supply end 911 of the packing strap 91 extends out of the strap outlet portion 351 (as shown in FIG. 3).

Figure 4:
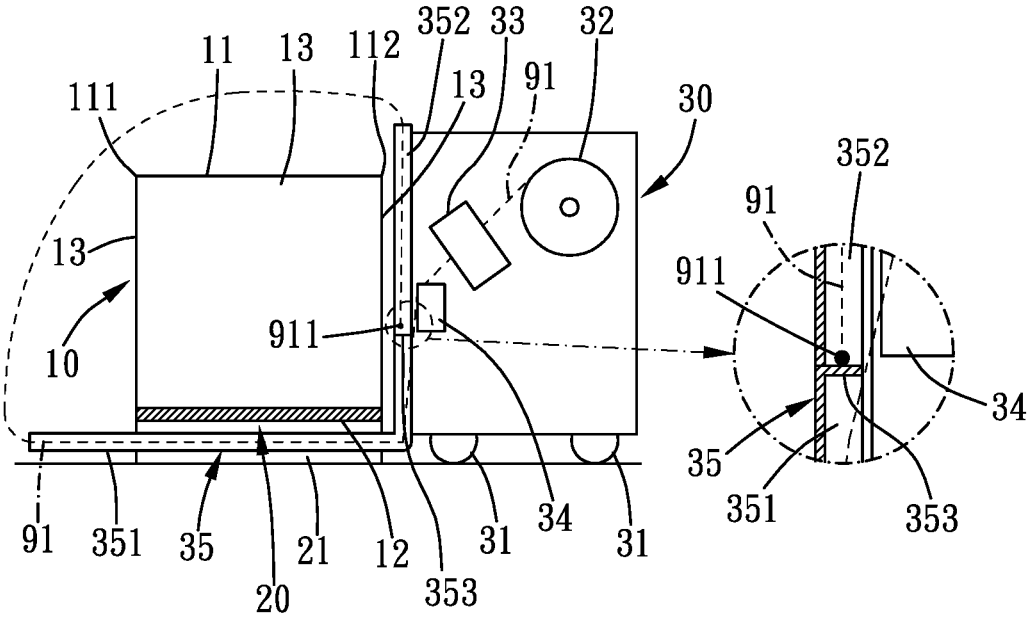
FIG. 4 is a perspective view of process 3 of the method for packing an article of the present invention.

4. encircling article step S4: pulling the packing strap 91 through the supply end 911 to wrap around the article 10 first, then passing the supply end 911 into the strap return portion 352, and fixing on the stopper portion 353 (it is stated here that this technology is a known technology and will not be described in detail), so that the packing strap 91 surrounds the article 10 (as shown in FIG. 4).

Figure 5:
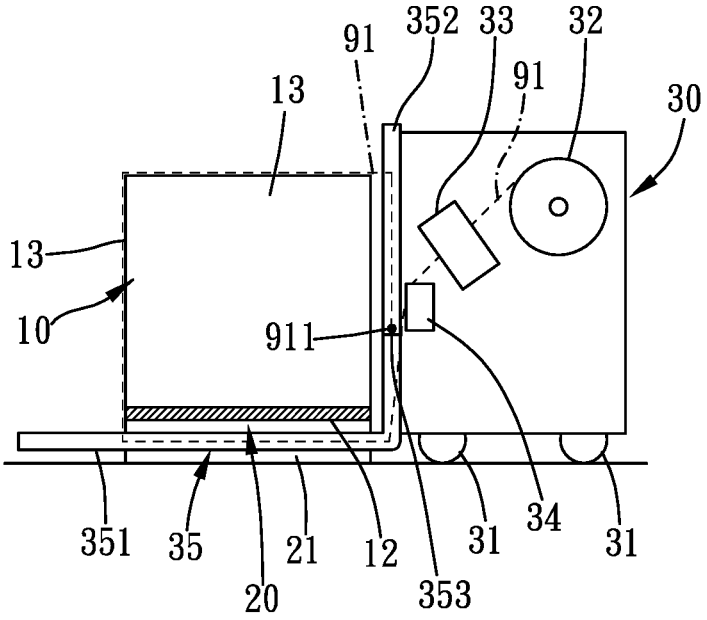
FIG. 5 is a perspective view of process 4 of the method for packing an article of the present invention.

5. first time tightening step S5: first controlling the strap feeding and retreating control unit 33 to tighten (the actual action is to pull backwards) the packing strap 91, so that the packing strap 91 is tightly wrapping around the article 10 (as shown in FIG. 5).

Figure 6:
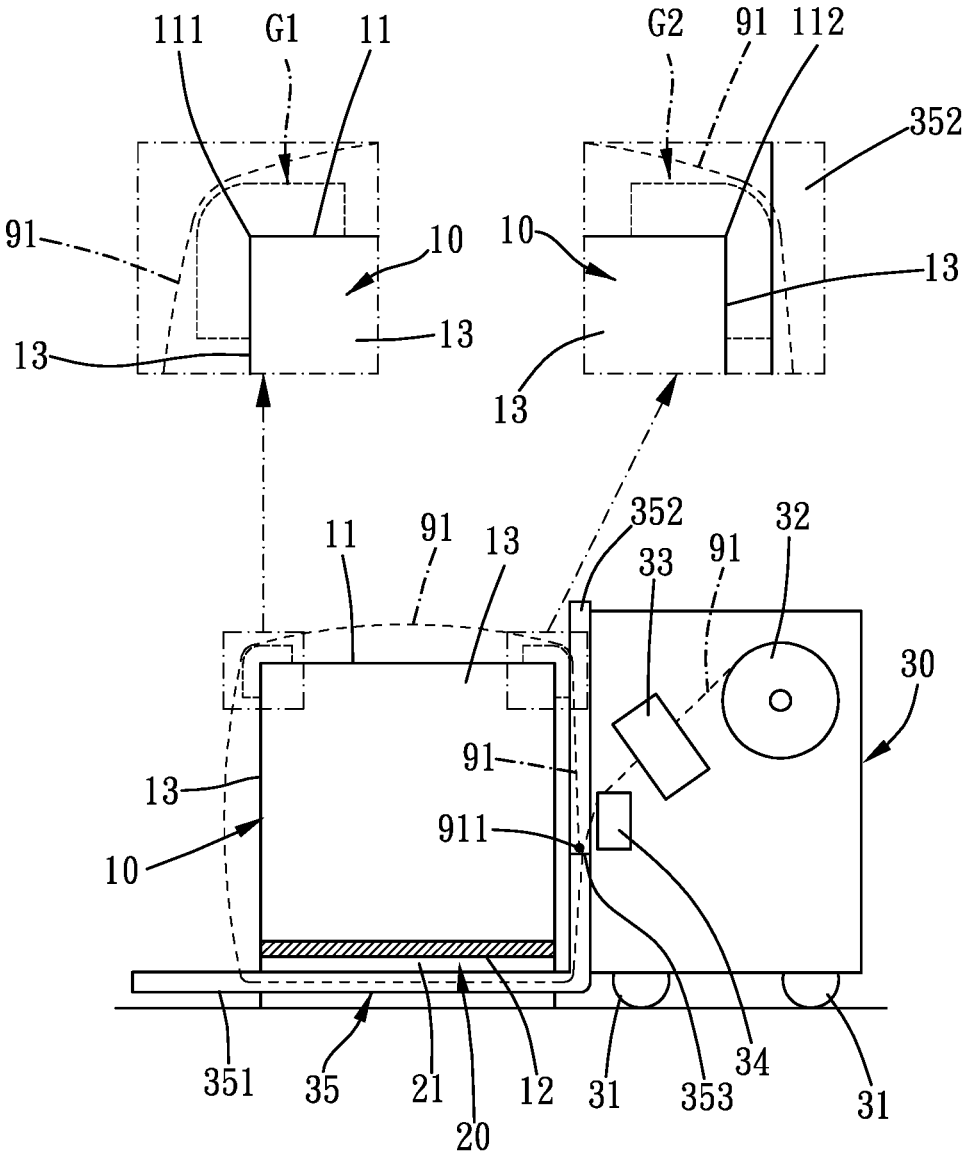
FIG. 6 is a perspective view of process 5 of the method for packing an article of the present invention.

6. a second time feeding strap step S6: controlling the strap feeding and retreating control unit 33 to automatically supply strap and pulling out (or called feeding) the packing strap 91 from the strap supply unit 32 to a first length so as to generate a first insertion space G1 between the packing strap 91 and the first edge 111, and a second insertion space G2 between the packing strap 91 and the second edge 112 (as shown in FIG. 6).

Figure 7:
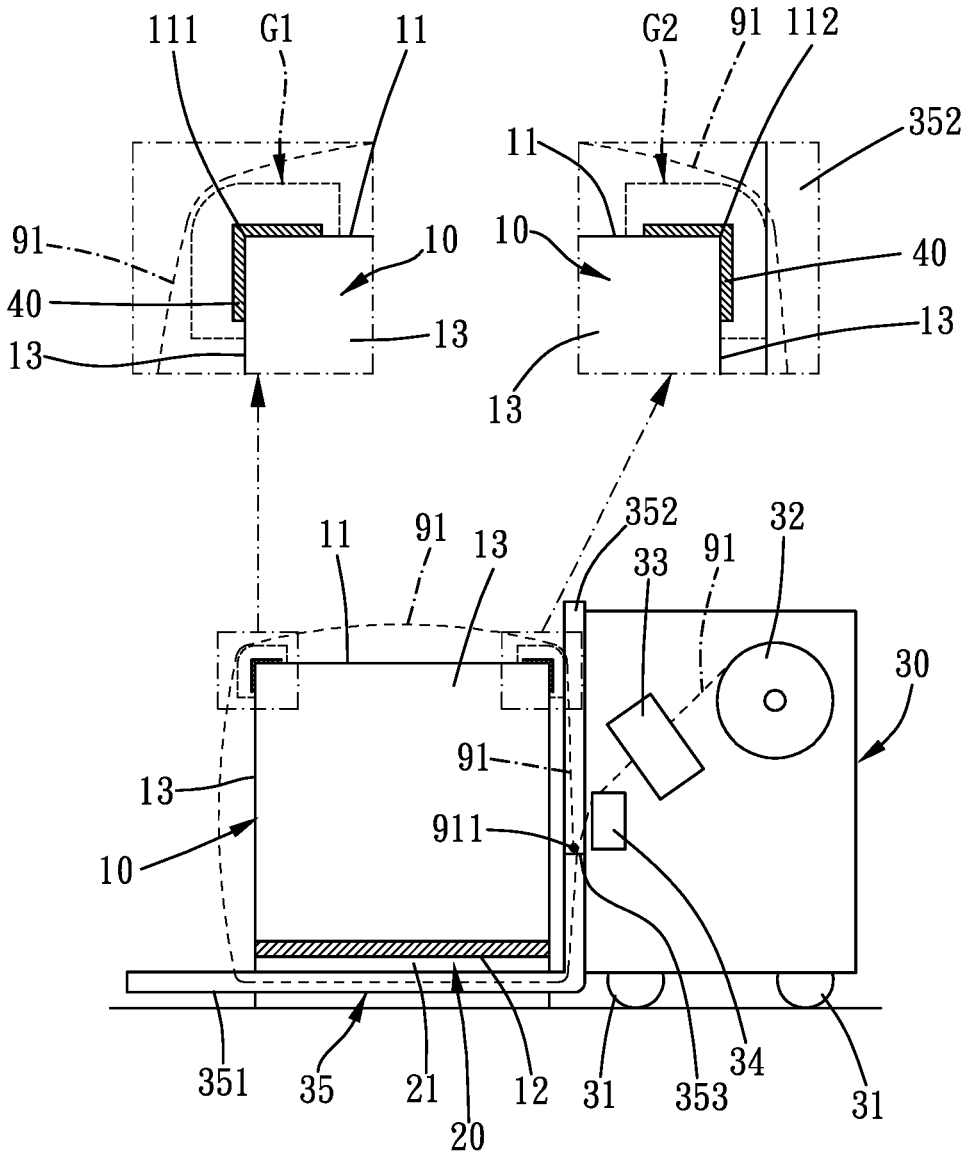
FIG. 7 is a perspective view of process 6 of the method for packing an article of the present invention.

7. manual inserting step S7: inserting the at least two right-angle pad elements 40 (to protect to the article 10 from packing strap's pressing/damaging) into the first insertion space G1 and the second insertion space G2, respectively, wherein the two right-angle pad elements 40 are all limited by the packing strap 91 and will not fall down (as shown in FIG. 7, the first insertion space G1 and the second insertion space G2 are omitted and will be described here).

Figure 8:
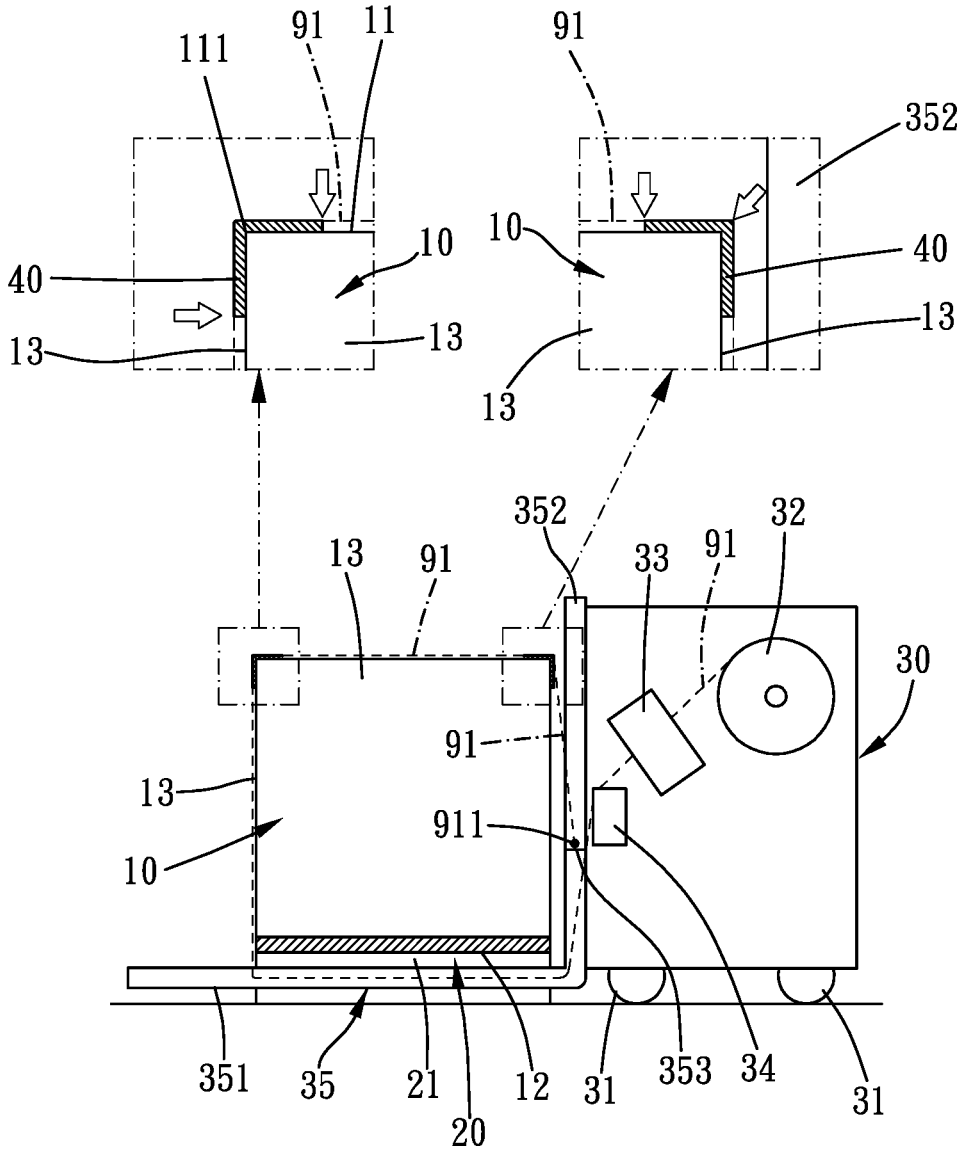
FIG. 8 is a perspective view of process 7 of the method for packing an article of the present invention.

8. second time tightening step S8: controlling the strap feeding and retreating control unit 33 to automatically tighten the packing strap 91, so that the packing strap 91 is tightly wrapping around the article 10 and the two right-angle pad elements 40 (as shown in FIG. 8).

Figure 9:
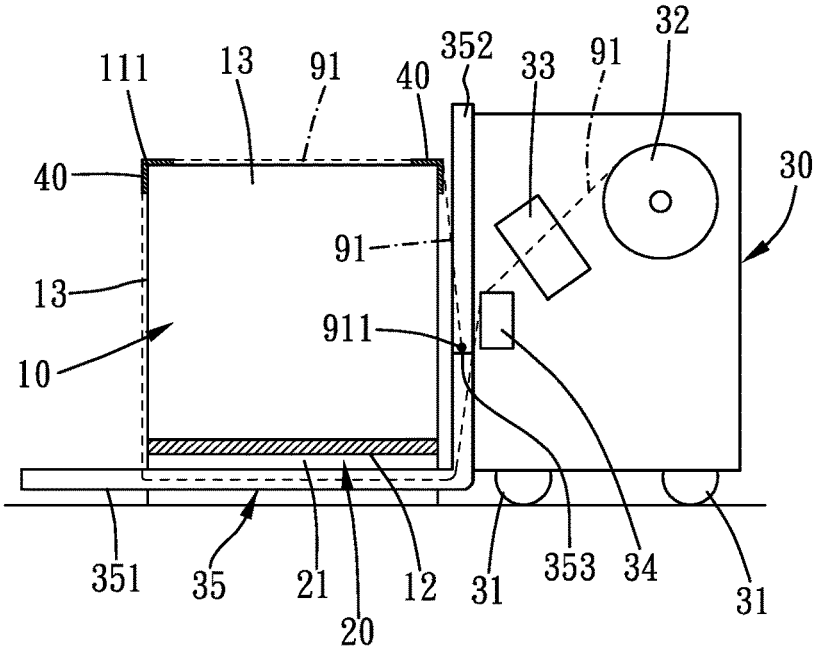
FIG. 9 is a perspective view of process 8 of the method for packing an article of the present invention.
Figure 10:
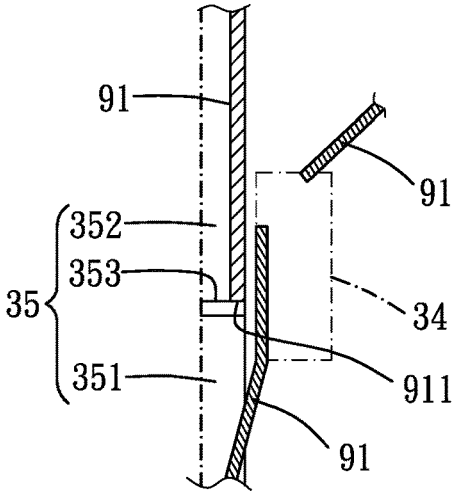
FIG. 10 is a perspective view of process 9 of the method for packing an article of the present invention.
Figure 11:
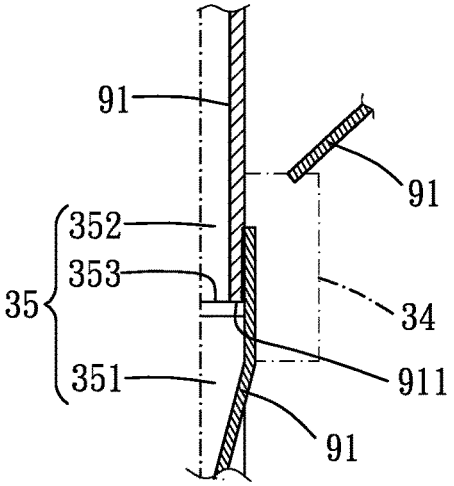
FIG. 11 is a perspective view of process 10 of the method for packing an article of the present invention.

9. strap cutting and bonding step S9: controlling the strap cutting and bonding unit 34 to cut off and form an overlapping portion adjacent to the supply end 911 and to bond the overlapping portion via thermal bonding (as shown in FIGS. 9, 10 and 11) so as to complete the action of packing article.

Practically, in the second time feeding strap step S6, the first length can be between 12-18 cm (which is suitable for most packing works on a regular-sized pallet).

Furthermore, the conventional method for packing an article on the pallet requires one specific person to operate the strapping machine exclusively. First, the L-shaped strap guide unit of the strapping machine inserts into the bottom space under the pallet, and then control the strap supply unit to supply the packing strap. Next, the packing strap is output through the L-shaped strap guide unit, and after one circle around the pallet and the article, the packing strap is inserted into and secured on the L-shaped strap guide unit, so that the packing strap is tightly wrapped around the article. Next, it is necessary to pull out the packing strap from the strap supply unit to create a gap between the packing strap and the article. The key point is that another person must place the two right-angle pad elements on the article and press and fix them with the hands of the other person (the hands have to keep pressing on) to prevent loosening or slipping. Then, the person who controls the strapping machine controls the packing strap to tighten so that the packing strap can be tightly tied to the article and the two right-angle pad elements. That is, two operators are necessary, and the manpower requirement for such packing work is relatively high in a conventional way.

However, in order to solve the aforementioned conventional problem, this invention is designed to include the second time feeding strap and the second time tightening step. After the packing strap 91 is tightly wrapping around the article 10 (that is, the first time tightening step S5), the present invention is specially designed to first control the strap feeding and retreating control unit 33 to "automatically" pull (or called feed) the packing strap 91 out of the strap supply unit 32 (supply strap) to the first length, so that a first insertion space G1 is generated between the packing strap 91 and the first edge 111, and a second insertion space G2 is generated between the packing strap 91 and the second edge 112 (as shown in FIG. 6). Please note that this step is automatic control without additional manpower operation. Then the person who controls the strapping machine can insert the two right-angle pad elements 40 into the first insertion space G1 and the second insertion space G2, respectively. The two right-angle pad elements 40 are all limited by the packing strap 91 and will not fall down (as shown in FIG. 7). Then control again (it is also automatic control, no human operation is required) the strap feeding and retreating control unit 33 tightens the packing strap 91, and finally completes that the packing strap 91 is tightly wrapping around the article 10 and the two right-angle pad elements 40 (as shown in FIG. 8).

Figure 12:
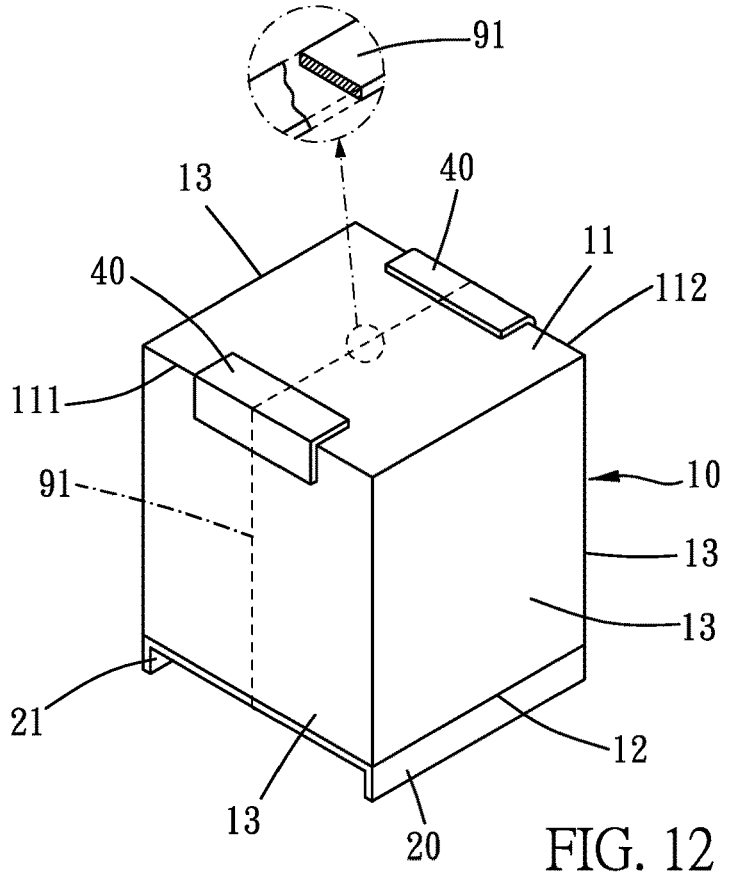
FIG. 12 is a perspective view of process 11 of the method for packing article of the present invention.
Figure 13:
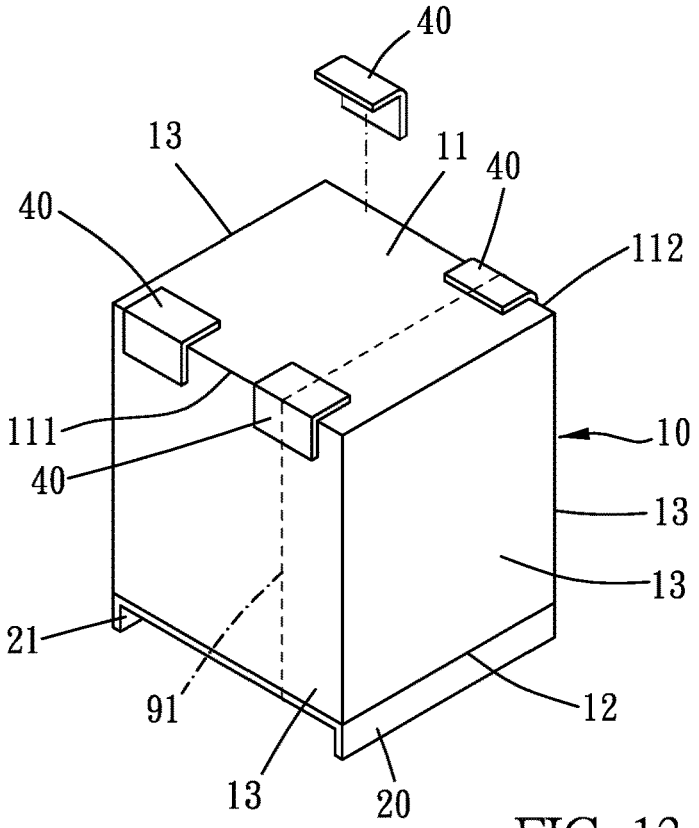
FIG. 13 is a perspective view of process 12 of the method for packing article of the present invention.
Figure 14:
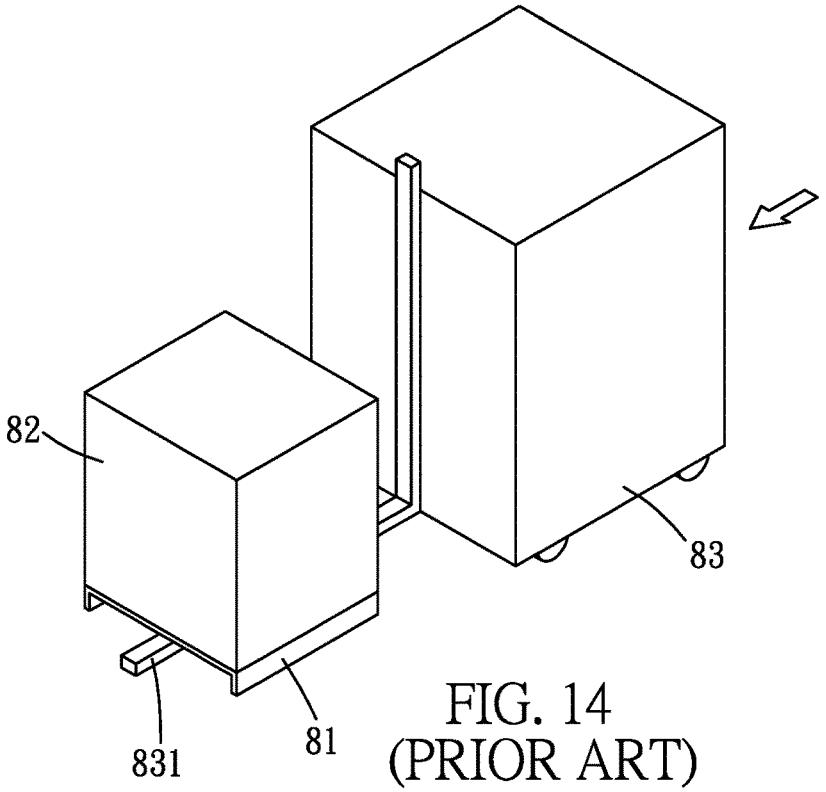
FIG. 14 (PRIOR ART)
FIG. 14 is a perspective view of process 1 of a conventional packing method.
Figure 15:
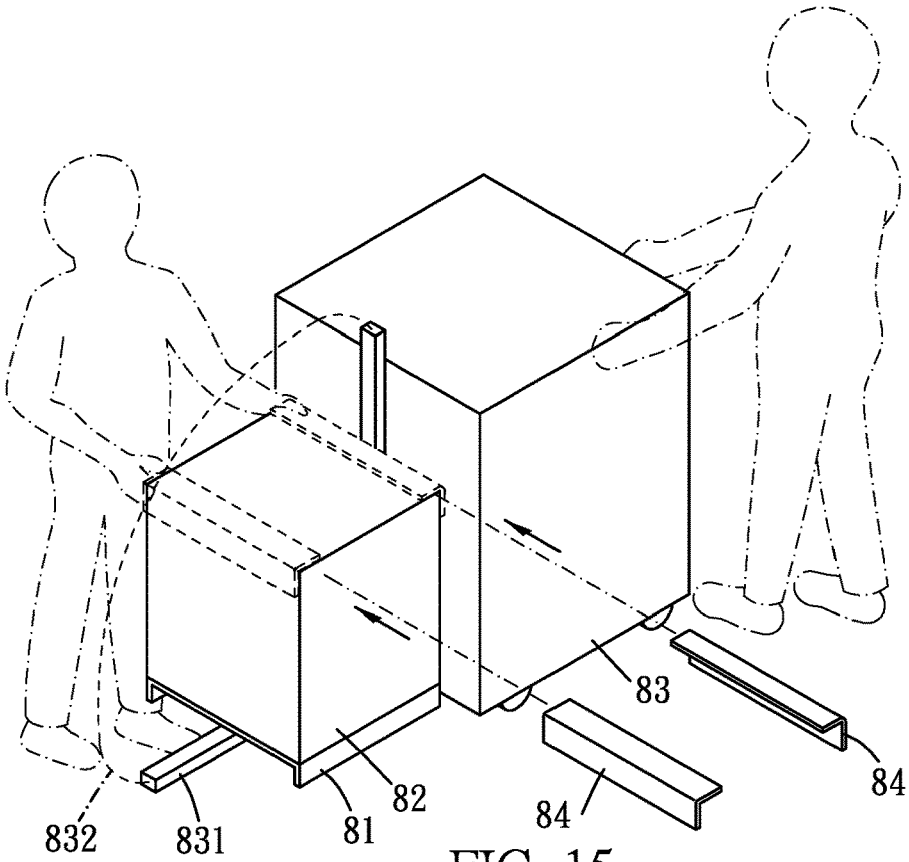
FIG. 15 (PRIOR ART)
FIG. 15 is a perspective view of process 2 of a conventional packing method.

Furthermore, the two right-angle pad elements 40 (as shown in FIG. 12) can be modified as four (or more), and are respectively arranged on article 10 in pairs (as shown in FIG. 13).

The advantages and effects provided by the present invention may include the following:

1. The two right-angle pad elements will not fall down after being placed. In the second time feeding strap step of the present invention, the strap feeding and retreating control unit is controlled to automatically pull the packing strap out of the first length. Further, the first insertion space and the second insertion space are generated between the article and the packing strap; in addition to facilitating the insertion of the two right-angle pad elements, the two right-angle pad elements are restricted by the packing strap and will not fall down (in principle, no hands are needed for fixing after insertion). Therefore, the two right-angle pad elements will not fall down after being placed.

2. It can be operated by one person only. Compared with the conventional strapping machine that requires two persons to work together, the present invention only needs one person, so the manpower requirement for such packing work is relatively low. Therefore, it can be operated by a single person.

What is claimed is:

1. A method for packing an article, comprising:

(1) a preparing step comprising preparing an article, a pallet, a strapping machine, and at least two right-angle pad elements, wherein the article has a top surface, a bottom surface, and four side surf aces respectively arranged thereon, the top surface having a first edge and a second edge respectively arranged thereon, the article being placed on the pallet via the bottom surface of the article, the pallet having a bottom space disposed thereon, wherein the strapping machine has a plurality of movable wheels, a strap supply unit, a strap feeding and retreating control unit, a strap cutting and bonding unit, and an L-shaped strap guide unit respectively arranged thereon, wherein the plurality of movable wheels are used to move the strapping machine, wherein the strap supply unit is used to provide a packing strap, wherein the packing strap has a supply end arranged thereon, wherein the supply end is capable of being pulled out from the strap supply unit, passing through the strap feeding and retreating control unit and the strap cutting and bonding unit in sequence, and finally being set on the L-shaped strap guide unit, wherein the L-shaped strap guide unit has a strap outlet portion, a strap return portion, and a stopper portion respectively arranged thereon, wherein the supply end is disposed on the strap outlet portion;

(2) a moving step comprising moving the strapping machine by the plurality of movable wheels, and then making the strap outlet portion of the L-shaped strap guide unit extend into the bottom space;

(3) a first strap feeding step comprising controlling the strap feeding and retreating control unit to feed the packing strap so that the supply end of the packing strap extends out of the strap outlet portion;

(4) an encircling article step comprising pulling the supply end of the packing strap to wrap the packing strap around the article, then passing the supply end into the strap return portion and fixing the supply end on the stopper portion so that the packing strap surrounds the article;

(5) a first tightening step comprising controlling the strap feeding and retreating control unit to tighten the packing strap, so that the packing strap is tightly wrapped around the article;

(6) a second strap feeding step comprising controlling the strap feeding and retreating control unit to pull out a first length of the packing strap from the strap supply unit so as to generate a first insertion space between the packing strap and the first edge, and a second insertion space between the packing strap and the second edge;

(7) a manual inserting step comprising inserting the at least two right-angle pad elements into the first insertion space and the second insertion space, respectively, wherein the at least two right-angle pad elements are respectively limited by the packing strap so as to prevent the at least two right-angle pad elements from falling down;

(8) a second tightening step comprising controlling the strap feeding and retreating control unit to automatically tighten the packing strap, so that the packing strap is tightly wrapped around the article and the at least two right-angle pad elements; and (9) a strap cutting and bonding step comprising controlling the strap cutting and bonding unit to cut off and form an overlapping portion of the packing strap adjacent to the supply end, and to bond the overlapping portion to the supply end via thermal bonding so as to complete packing of the article.

2. The method for packing an article, as recited in claim 1, wherein in the second strap feeding step, the first length is between 12 and 18 centimeters.

* * * * *